US006559809B1

(12) United States Patent
Mohammadian et al.

(10) Patent No.: US 6,559,809 B1
(45) Date of Patent: May 6, 2003

(54) PLANAR ANTENNA FOR WIRELESS COMMUNICATIONS

(75) Inventors: Alireza H. Mohammadian, San Diego, CA (US); Ernest T. Ozaki, Poway, CA (US); Patrick J. Conner, Encinitas, CA (US)

(73) Assignee: Qualcomm Incorporated, San Diego, CA (US)

( * ) Notice: Subject to any disclaimer, the term of this patent is extended or adjusted under 35 U.S.C. 154(b) by 0 days.

(21) Appl. No.: 09/997,147

(22) Filed: Nov. 29, 2001

(51) Int. Cl.[7] ..... H01Q 1/24; H01Q 9/28
(52) U.S. Cl. ..... 343/795; 343/702; 343/792
(58) Field of Search ..... 343/795, 790, 343/792, 794, 702, 700 MS, 810, 864; H01Q 1/24, 9/28

(56) References Cited

U.S. PATENT DOCUMENTS 3,887,925 A * 6/1975 Ranghelli et al. ..... 343/795
5,598,174 A * 1/1997 Erkocevic et al. ..... 343/795
5,754,145 A * 5/1998 Evans ..... 343/795
5,949,383 A * 9/1999 Hayes et al. ..... 343/795
6,037,911 A * 3/2000 Brankovic et al. ..... 343/795
6,222,494 B1 * 4/2001 Erkocevic ..... 343/795

* cited by examiner

*Primary Examiner*—Hoanganh Le
(74) *Attorney, Agent, or Firm*—Philip R. Wadsworth; Kent D. Baker; Donald C. Kordich

(57) ABSTRACT

Embodiments of a planar antenna suitable for use with a portable device for wireless communications are described. One such embodiment includes a microstrip line coupled to a radiating poise on one side of a circuit board, and a ground plane coupled to a structure on the other side of the circuit board that functions as a coplanar waveguide having an effective length of one quarter-wavelength. A further implementation includes a transformer portion configured and arranged to match the impedance of an RF signal source to the antenna driving impedance.

18 Claims, 21 Drawing Sheets

PLANAR ANTENNA FOR WIRELESS COMMUNICATIONS

BACKGROUND

1. Field of the Invention

The present invention relates to antennas for wireless communications.

2. Background Information

Portable devices having wireless communications capabilities are currently available in several different forms, including mobile telephones and personal digital assistants (PDAs). A portable device such as a wireless modem may also be used to provide such capabilities to a laptop or other computer (e.g. via a datalink to the computer such as wired RS-232, infrared, or Bluetooth). The field of applications for such devices is expanding rapidly, including such features and functionalities as high data rates, access to Internet and e-mail services, simultaneous transmission of voice and data, and video capabilities.

One type of antenna commonly used in portable devices for wireless communications is the monopole whip. A monopole whip antenna is essentially a wire that extends along or away from the device and is fed by a printed circuit board (PCB) of the device. One problem of this unbalanced design is that RF currents induced on the PCB may cause receiver desensitization, thereby limiting the useful range of the device.

In a monopole whip design as described above, and other unbalanced designs used in similar applications, the PCB may function as a part of the antenna. As a result, the PCB may also radiate a portion of a signal being transmitted, causing operating characteristics of the antenna such as gain, radiation pattern, and driving point impedance to become dependent on qualities of the PCB such as size, shape, and proximity to other structures (such as a display, a cable, a battery pack, etc.). Therefore, it may become necessary to redesign the antenna to achieve a similar performance with different applications and/or different types of devices.

Radiation by a PCB due to RF coupling with an unbalanced antenna may also cause efficiency losses. In a mobile phone application, for example, radiation of a PCB that is placed next to the user's head may be wasted due to absorption of the radiating fields by the user's head and hand. In addition to reducing the efficiency of the device, this effect may also increase the specific absorption rate (SAR) beyond regulatory limits.

Inefficiencies due in part to PCB radiation may also occur in applications other than mobile telephones. For example, a wireless modem may be designed to attach to the back of the display of a laptop computer (e.g. by clip or VELCRO®). Such a modem may include dual unbalanced whip antennas (e.g. for diversity reception) mounted to extend above the display. Due to the unbalanced feeding arrangement, however, the modem PCB ground plane may become part of the radiating antenna. Hence a portion of the radiated signal may be blocked by the laptop display panel, which may cause distorted radiation patterns, reduced antenna gain, and unwanted coupling to and from electronics in the laptop display.

Use of one or more unbalanced antennas in PCMCIA card devices (such as wireless modems) may cause similar problems. In this case, a portion of the radiator is the PCMCIA card PCB ground plane, at least a part of which is enclosed within the laptop's metal case when the card is inserted into the PCMCIA slot of the laptop. The radiating structure is then an L-shaped dipole, half of which is buried in the laptop. The potential for pattern distortions and possible EMI problems (e.g. due to unwanted coupling and blockage by the laptop structure) is high. Additionally, the performance of this type of antenna system may vary for different laptop designs, due to differences in local grounding conditions and the proximities of metal surfaces to the PCMCIA card.

A coaxial sleeve dipole is a balanced antenna that tends to de-couple the antenna system from the circuit board or device to which it is connected. Such an antenna is constructed of coaxial cable, where the center conductor extends beyond the outer conductor, and the outer conductor is rolled back to form a jacket. One advantage of this design is that if the jacket has the right length, then current which otherwise might distort the radiation pattern may be impeded from flowing along the outer surface of the feed cable. Unfortunately, coaxial sleeve dipoles are too bulky and heavy to be practical for use in small portable devices and are not compatible with the small, slim profiles of present portable wireless devices. Additionally, coaxial sleeve dipoles are relatively expensive.

The demand for wireless connectivity from portable devices is rapidly expanding. As a result, the demand for high performance, low cost, and cosmetically appealing antenna systems for such devices is also increasing. Therefore, an antenna that reduces RF coupling problems and that may be fabricated to have features such as a low profile, light weight, and low cost is desired.

SUMMARY

An antenna according to one embodiment of the invention includes a substrate, a first conductor, and a second conductor. The substrate has two opposing surfaces, and the two conductors are disposed on opposing surfaces of the substrate. The first conductor has a feed line portion and a poise portion, while the second conductor has a ground plane portion and a counterpoise portion. In one example, the counterpoise portion includes two stubs on opposite sides of the ground plane portion, which stubs may be substantially parallel to the ground plane portion and/or may have lengths of one quarter-wavelength at a frequency within a predetermined range.

The feed line portion may be configured and arranged to operate as a microstrip transmission line, while a portion of the second conductor including the counterpoise portion may be configured and arranged to operate as a coplanar waveguide. In such case, the coplanar waveguide may be configured and arranged to impede a flow of a common mode current over a predetermined frequency range. For example, the coplanar waveguide may be configured and arranged to have a high input impedance over the predetermined range. Other embodiments of antennas, and of assemblies including features of two or more such antennas, are also described herein.

DETAILED DESCRIPTION

Figure 1:
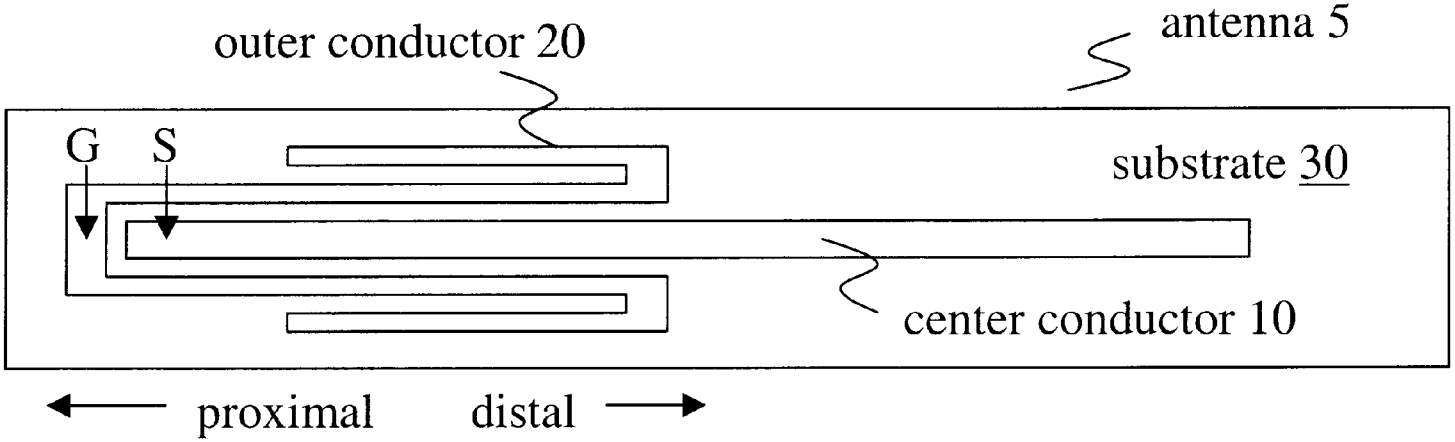
FIG. 1 shows a single-sided antenna.

FIG. 1 illustrates a PCB antenna 5 that includes a center conductor 10 and an outer conductor 20 on the same surface of a substrate 30. An RF signal for transmission is applied to the proximal end of center conductor 10 (e.g. at source connection point S), with a corresponding ground potential being applied to the proximal end of outer conductor 20 (e.g. at ground connection point G).

Figure 2A:
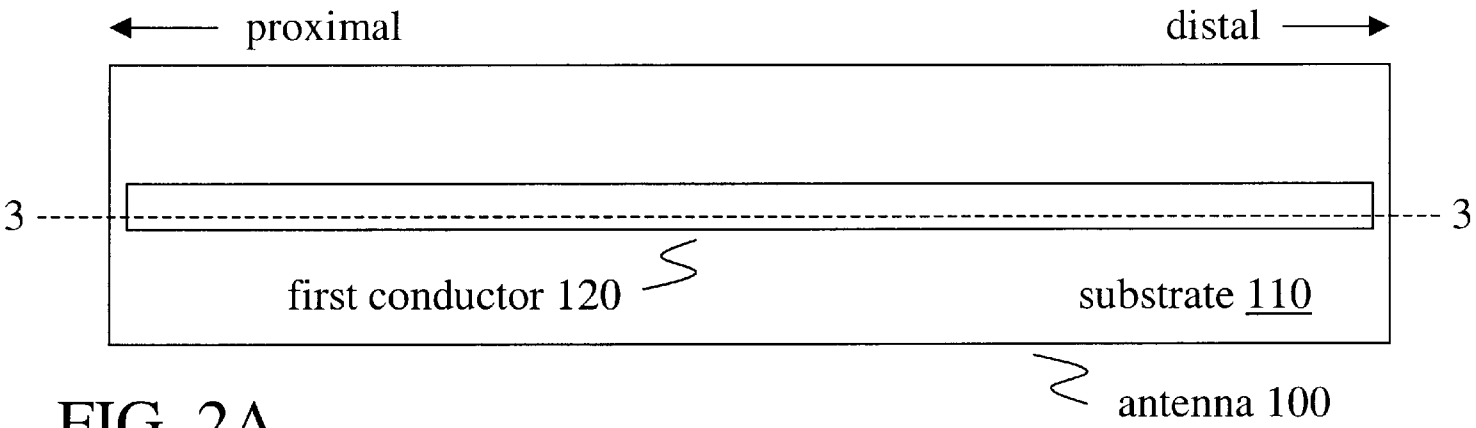
FIG. 2A shows a top view of an antenna according to an embodiment of the invention.
Figure 2B:
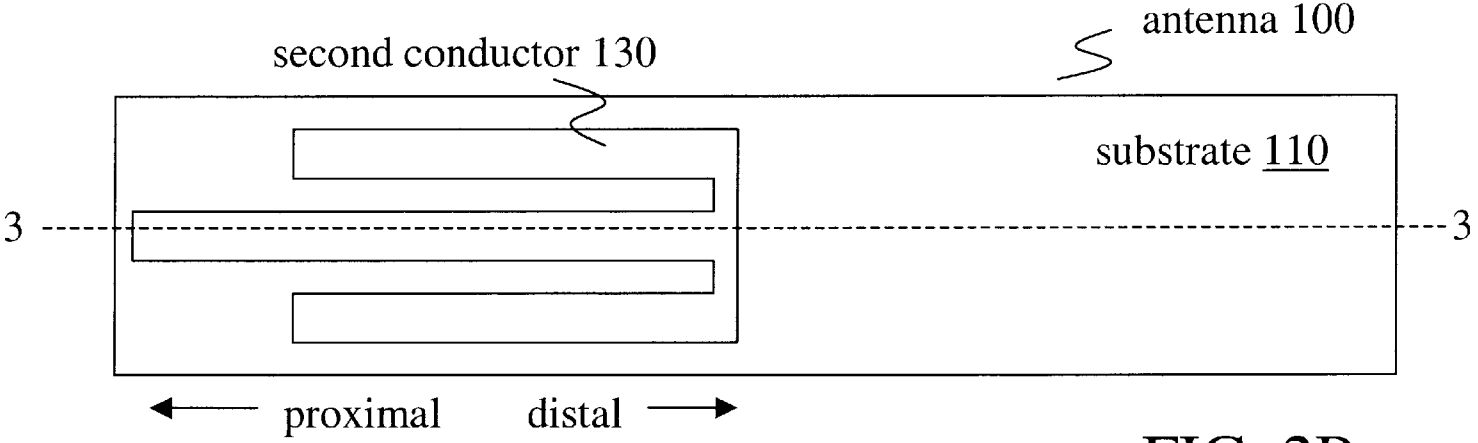
FIG. 2B shows a bottom view of an antenna according to an embodiment of the invention as shown in FIG. 2A.
Figure 3:
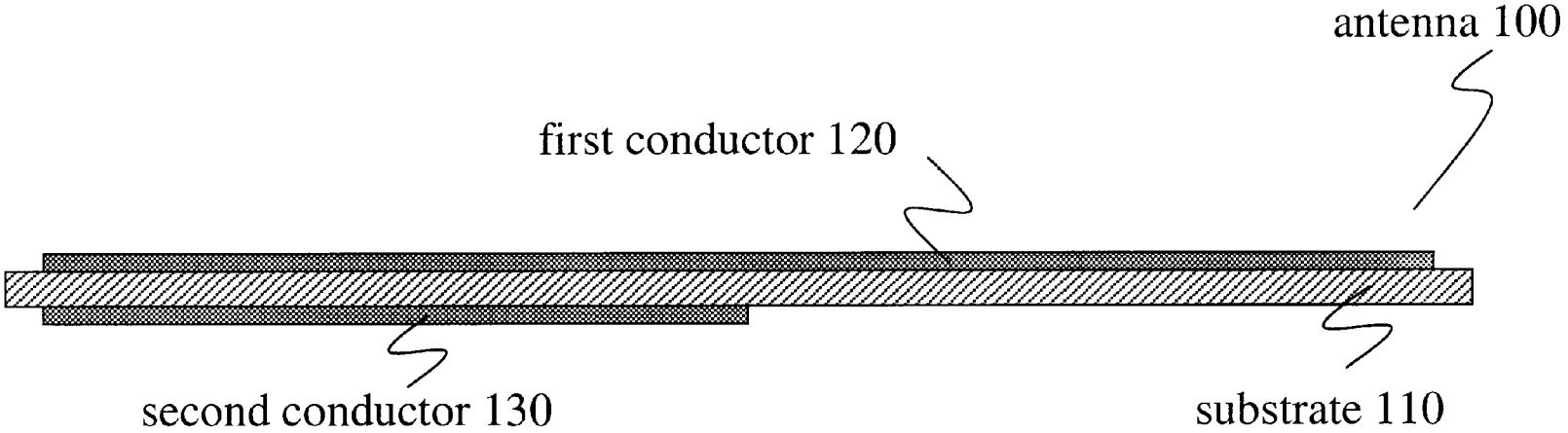
FIG. 3 shows a cross-sectional view (along axis 3—3 as shown in FIGS. 2A and 2B) of an antenna according to an embodiment of the invention.

FIGS. 2A, 2B, and 3 show top, bottom, and cross-sectional views, respectively, of a planar antenna according to an embodiment of the invention. In an exemplary implementation, substrate 110 is the substrate portion of a printed circuit board. Initially, the substrate of this implementation is covered (e.g. laminated or roller-clad) with a conductive layer of material (e.g. copper) on each surface, these layers being selectively etched away or otherwise removed to form a first conductor 120 on one surface and a second conductor 130 on the other. In such case, substrate 110 may contain an epoxy- or polyimide-based material: for example, a phenolic or glass epoxy resin (e.g. G10 or FR4).

Alternatively, substrate 110 may be another non-conductive material such as a silicon wafer or a rigid or flexible plastic material. In some cases (e.g. where the substrate is flexible or formed to a non-flat shape), the planar antenna may be applied in a curved, twisted, or conformal configuration. As for conductors 120 and/or 130, these may include areas formed by deposition and/or implantation of a conductive material onto substrate 110.

Certain desirable properties such as increased efficiency may be obtained by using a material for substrate 110 that has a low loss (as expressed in terms of, e.g., quality factor or dissipation factor), or a particular permittivity or dielectric constant, at the desired frequency or frequency range of operation. For example, a material based on TEFLON® or another fluoropolymer may be used. It may also be desirable for substrate 110 to have a thickness that is substantially less than one wavelength (at the desired frequency or frequency range of operation).

Figure 4A:
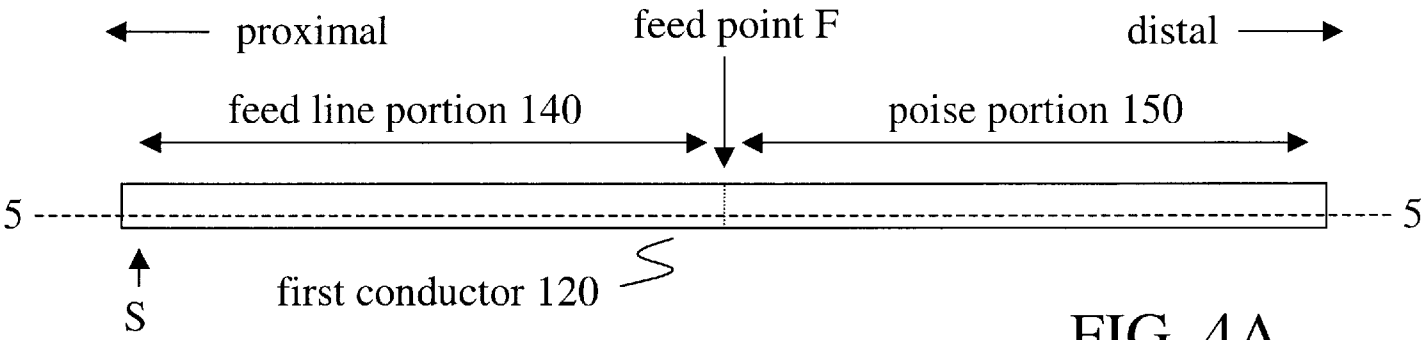
FIG. 4A shows a schematic diagram of first conductor 120.
Figure 4B:
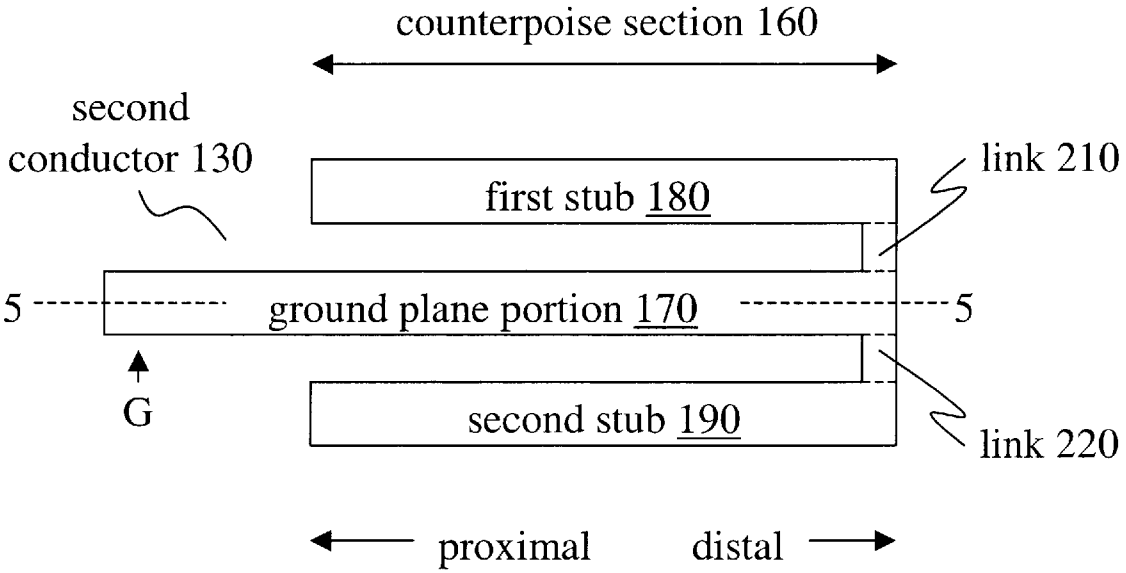
FIG. 4B shows a schematic diagram of second conductor 130.
Figure 5:
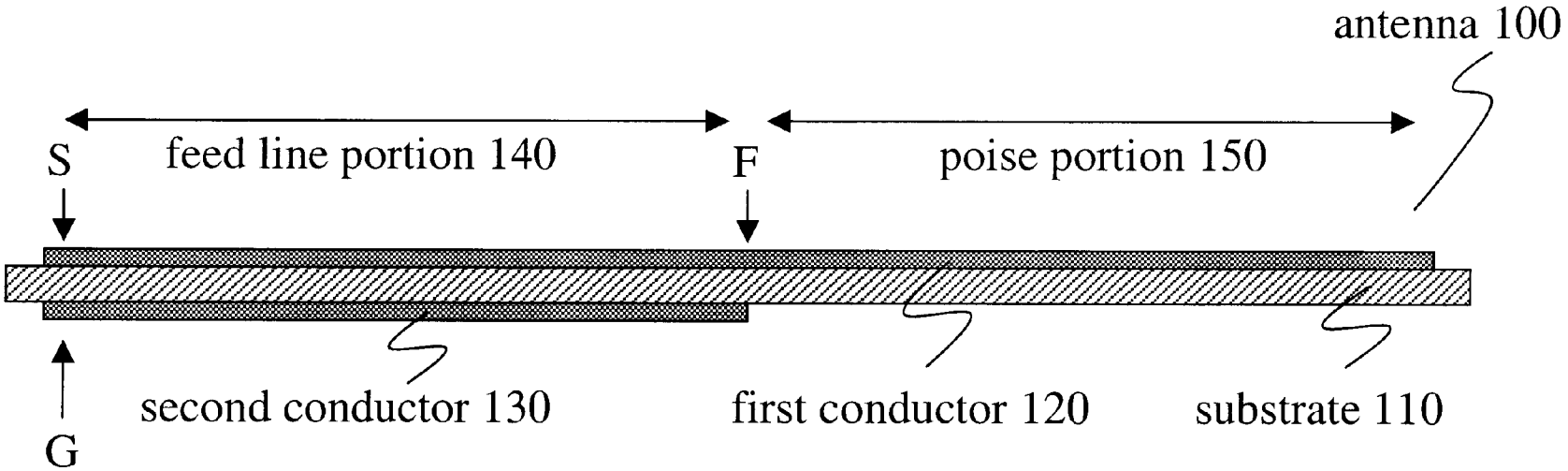
FIG. 5 shows a cross-sectional schematic diagram (along axis 5—5 as shown in FIGS. 4A and 4B) of an antenna according to an embodiment of the invention.

Each of the first and second conductors 120 and 130 may be considered to have multiple operating portions. As shown in FIGS. 4A and 5, for example, first conductor 120 may be considered to have a feed line portion 140 and a poise portion 150, these two portions meeting near an antenna feed point F. As shown in FIG. 4B, second conductor 130 may be considered to have a ground plane portion 170 and first and second stubs 180 and 190, each stub being connected to ground plane portion 170 near feed point F via a conductive link 210, 220.

Principles of operation of an antenna as shown in FIGS. 2A, 2B, and 3 may be explained as follows. An RF (excitation) signal is applied between feed line portion 140 and ground plane portion 170 at the proximal ends of conductors 120 and 130 (e.g. at source connection point S and ground connection point G). Radio-frequency-suitable connections such as attachments for coaxial cable leads or spring leads may be provided on antenna 100 for such purpose. With ground plane portion 170 as its ground plane, feed line portion 140 operates as a microstrip transmission line to carry the RF signal received at source connection point S to antenna feed point F.

A voltage at the gap between feed line portion 140 and ground plane portion 170 at feed point F, as created by the RF signal, causes an RF current to flow on poise portion 150. The differential current $I_d$ carried by feed line portion 130 returns to the source (i.e. to point S) along the surface of ground plane portion 170 that is closest to feed line portion 140.

The energy radiated by poise portion 150 may also induce a common mode current $I_c$ that flows away from feed point F along the surface of stubs 180 and 190 closest to feed line portion 140. Upon reaching the proximal ends of stubs 180 and 190, this common mode current may tend to flow around to the other side of the stubs (i.e. to the surface of the stubs that is farthest from feed line portion 140) and return to the distal ends of the stubs. If the common mode current $I_c$ is permitted to flow along ground plane portion 170 and return to the source at point S, problems may arise such as unwanted RF radiation from feed line portion 140 and excessive RF coupling of antenna 100 to the source (e.g. a PCB supplying the RF signal and to which antenna 100 is connected).

In designing an antenna as shown in FIGS. 2A, 2B, and 3, the lengths of stubs 180 and 190 may be selected to impede a flow of common mode current $I_c$ back to the source. This impedance effect may be explained by considering that ground p lane portion 170 and stubs 180 and 190 form a coplanar waveguide (CPW) transmission line. According to this model, ground plane portion 170 forms the center conductor of the CPW, and stubs 180 and 190 form the outer conductors (i.e. the two ground plane surfaces) of the CPW. The waveguide is short-circuited at its distal end by conductive links 210 and 220.

If the effective length of the CPW is approximately one quarter-wavelength (e.g. at the center frequency of the desired operating band), then the impedance at the open end of the CPW (e.g. at the proximal ends of stubs 180,190) may be nearly infinite at the operating frequency. This impedance resists the flow of common mode current $I_c$ back to the source along ground plane portion 170, resulting in a tendency for the antenna to be more balanced in the sense that radiation by the feed line is reduced or eliminated. In such a case, it may be desirable for poise portion 150 to have an effective length of approximately one quarter-wavelength as well. In another application, the effective lengths of the poise and counterpoise portions may be another multiple of one-quarter wavelength (e.g. ¾λ).

It is understood that any explanation of a theory of operation of an antenna according to an embodiment of the invention is presented herein for explanatory purposes only. Notably, such explanation does not itself represent or impose any limitation on any arrangement as set forth in the claims below. Additionally, it is understood that such an antenna may operate to be excited by a radiated signal (i.e. in a receiving mode).

It may be considered that a radiating element of antenna 5 as shown in FIG. 1 is fed by a CPW. As opposed to such a design, a microstrip-fed implementation as shown in FIG. 2A, 2B, and 3 may allow for more flexibility in increasing the impedance seen by the common mode current $I_c$ in the path to the feed line ground plane. For example, the microstrip feed line of antenna 100 may be made thin as compared to the CPW feed line of antenna 5, thus allowing for more gap space between the feed line ground plane and the counterpoise ground planes. Increasing this gap may tend to increase the impedance seen by the common mode current in the path to the feed line ground plane.

Other possible advantages of a microstrip-fed design include increased efficiency, as a microstrip transmission line may have lower dissipative and radiative losses than a corresponding CPW. Moreover, the propagating fields for microstrip lines may tend to be coupled more tightly to the ground plane than those for a CPW, which effect may reduce losses due to radiation from the feed line and minimize distortion of the radiating pattern due to stray radiation.

Figure 6A:
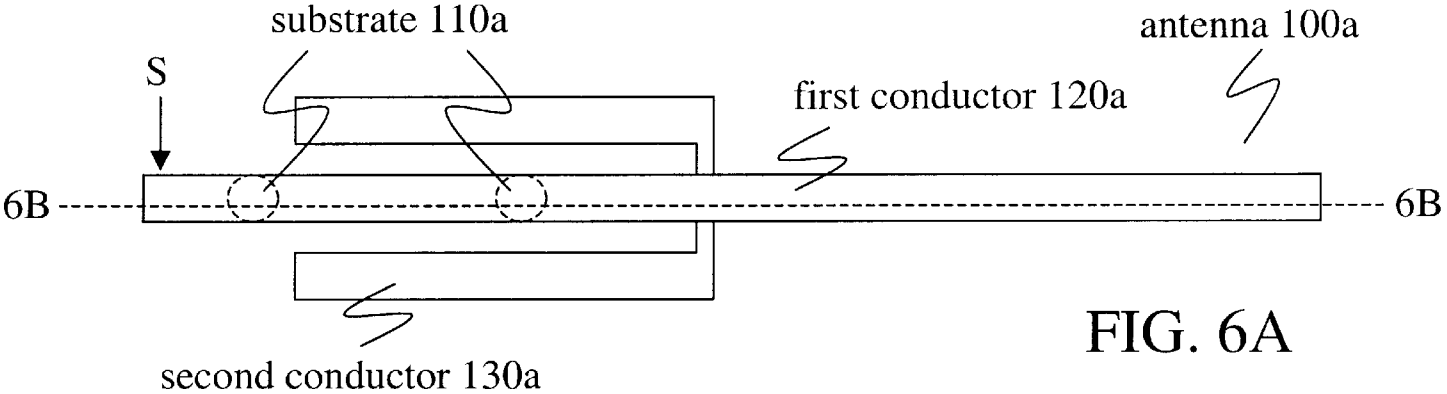
FIG. 6A shows a top view of an antenna according to an embodiment of the invention.
Figure 6B:
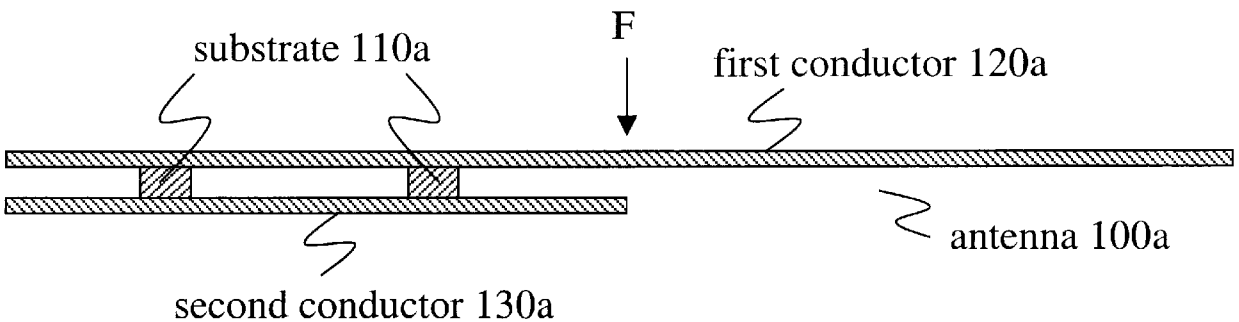
FIG. 6B shows a cross-section of an antenna according to an embodiment of the invention as shown in FIG. 6A.

Substrate 110 may have dimensions in the longitudinal and transverse directions that are larger than those of first conductor 120 and second conductor 130, thus supporting those structures and maintaining a substantially constant separation between them. Such an arrangement is shown, for example, in FIGS. 2A,B. As shown in FIGS. 6A,B, a substrate 110*a* of an antenna 100*a* according to an alternate embodiment of the invention may comprise spacers that are smaller in one or both directions than first conductor 120*a* and/or second conductor 130*a*. Such an arrangement may be suitable, for example, in a situation where the antenna will be otherwise protected from deformation and where very low cost is desired. In this case, conductors 120*a*, 130*a* may be fabricated (e.g. cut or stamped) from a sheet material or molded. In another example, the conductors may be encased in a rigid material (such as epoxy resin) to maintain a uniform separation between them.

Figure 7A:
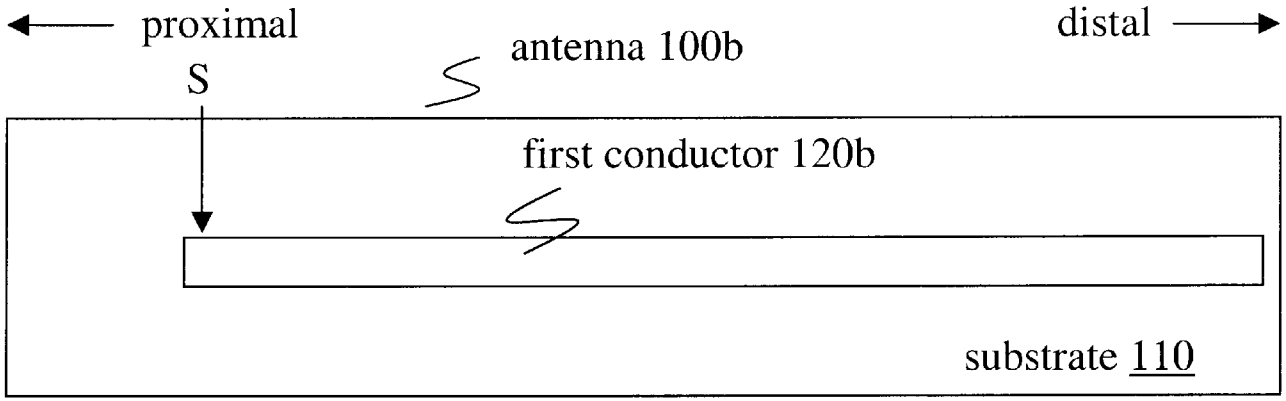
FIG. 7A shows a top view of an antenna according to an embodiment of the invention.

In an antenna 100*b* according to an embodiment of the invention as shown in FIGS. 7A (top) and 7B (bottom), stubs 180 and 190 may extend at a proximal end beyond signal and ground points S and G, respectively. Such a design may be selected to increase an effective length of the CPW at the desired frequency or frequency range of operation (i.e. in relation to its physical length). Alternatively, such a design may be selected to alter an impedance characteristic of the CPW. A further option in this regard is to meander stubs 180 and 190 and/or ground plane portion 170 to increase the ratio between the effective and physical lengths of the CPW.

Figure 7B:
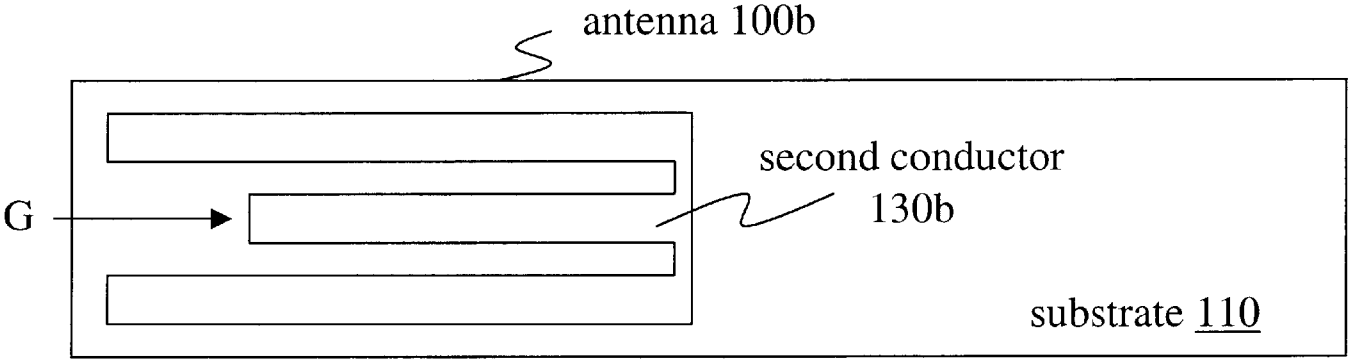
FIG. 7B shows a bottom view of an antenna according to an embodiment of the invention as shown in FIG. 7A.
Figure 8A:
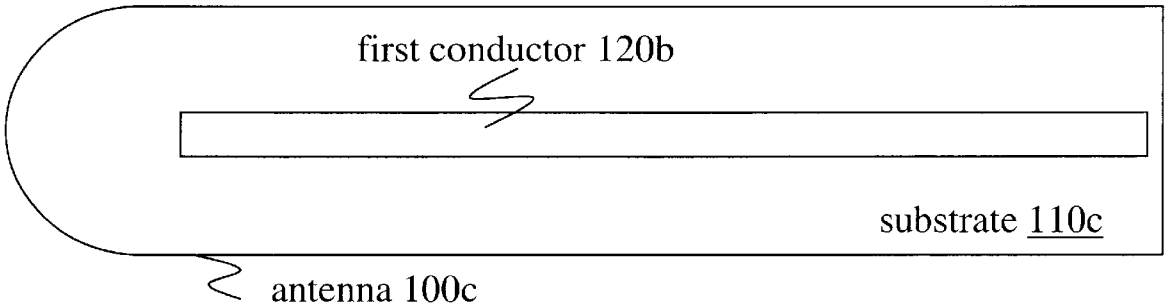
FIG. 8A shows a top view of an antenna according to an embodiment of the invention.
Figure 8B:
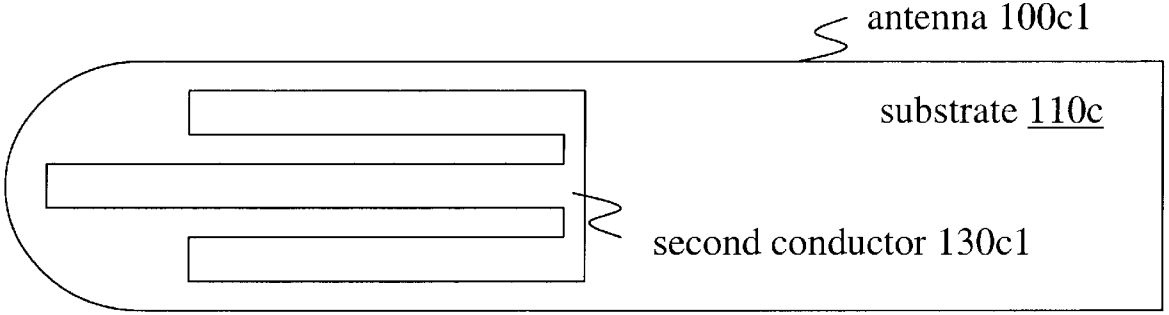
FIG. 8B shows a bottom view of an antenna according to an embodiment of the invention.
Figure 8C:
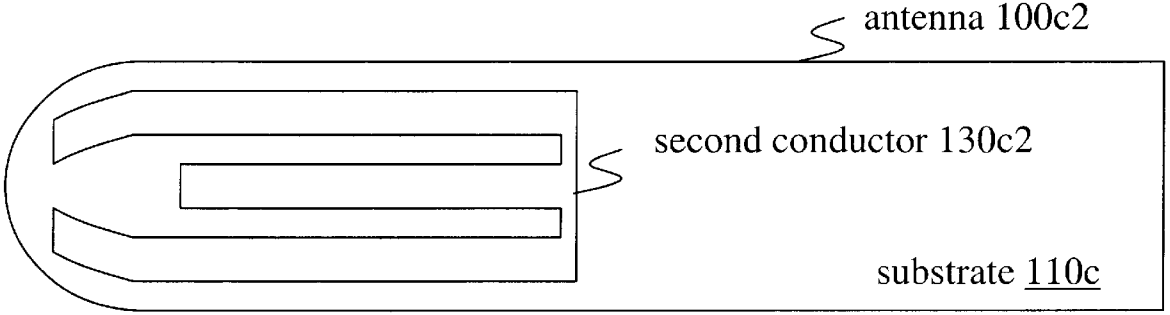
FIG. 8C shows a bottom view of an antenna according to an embodiment of the invention.

It may be desirable to curve at least the proximal end of a substrate of an antenna as described herein. FIG. 8A shows a top side of an antenna 100*c* according to an embodiment of the invention having a substrate 110*c* that is curved at the proximal end. FIG. 8B shows a bottom side of one variant 100*c*1 of antenna 100*c* having a second conductor 130*c*1 as shown in FIG. 2B above. FIG. 8C shows a bottom side of another variant 100*c*1 of antenna 100*c* having a second conductor 130*c*2 similar to that shown in FIG. 7B, the stubs also being curved in this case. One advantage that may be gained from such designs is a reduction in the length of the substrate.

Figure 9B:
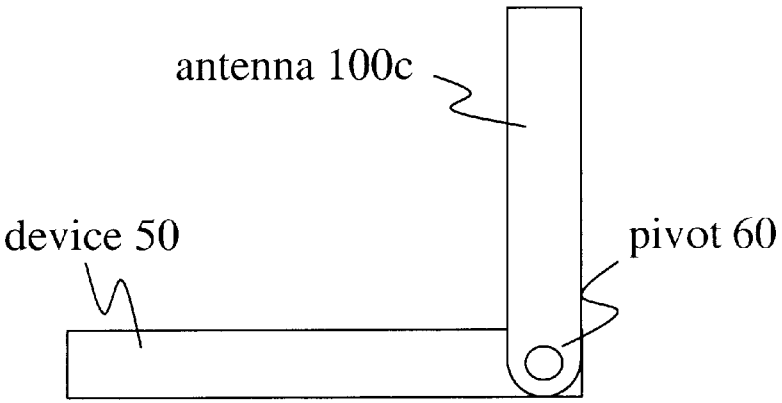
FIGS. 9A, 9B, 9C show side views of a portable device having an antenna according to an embodiment of the invention in various stages of deployment.
Figure 9A:
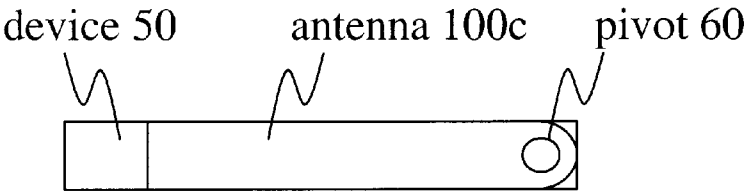
Figure 9C:
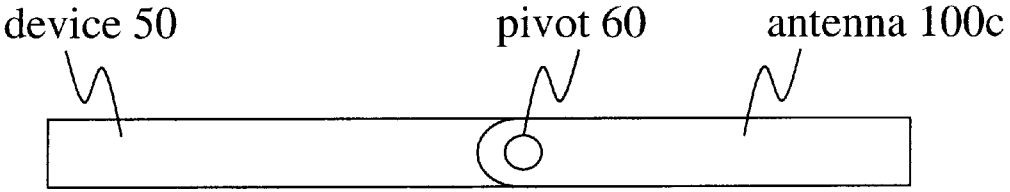
Figure 10C:
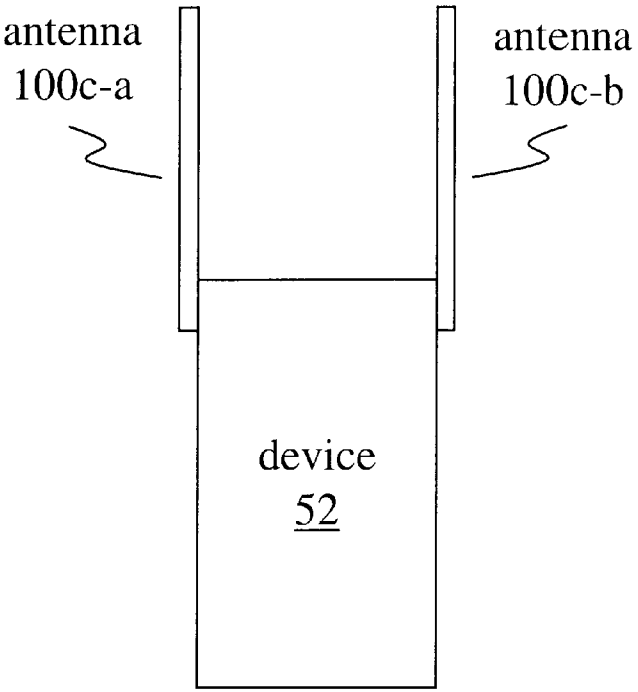
FIG. 10C shows a front view of a portable device having two antennas according to embodiments of the invention.
Figure 10B:
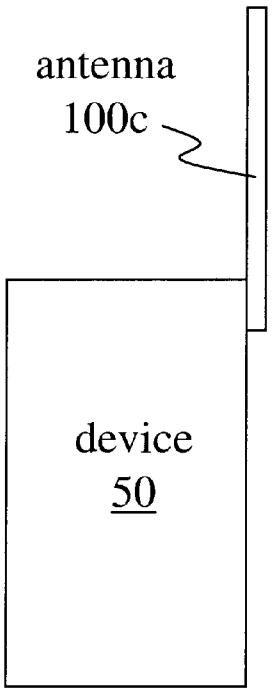
FIGS. 10A,10B show front views of a portable device having an antenna according to an embodiment of the invention in various stages of deployment.
Figure 10A:
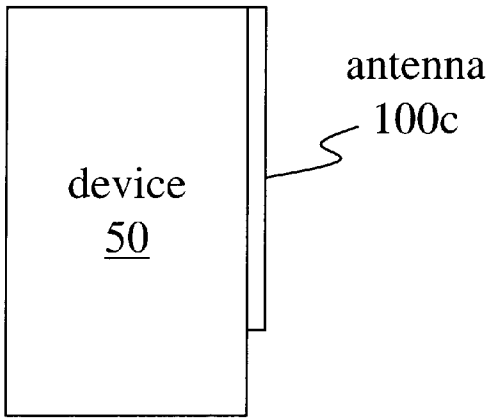

Another possible advantage of curving at least the proximal end of a substrate 110*c* is a reduction in the clearance area required to allow rotation of the antenna about a point near the proximal end. FIGS. 9A and 10A show side and front views, respectively, of how antenna 100*c* may be stored along a side of a portable device 50 (e.g. a cellular telephone, PDA or handheld computer, PCMCIA card, or wireless modem cabled to a computer). FIG. 9B shows a side view of how antenna.100*c* may be pivoted around pivot 60 into a partly extended position. FIGS. 9C and 10B show side and front views, respectively, of how antenna 100*c* may be pivoted into a fully extended position. FIG. 10C shows a front view of a portable device 52 having two such antennas 100*c-a*, 100*c-b* in fully extended position.

Figure 11:
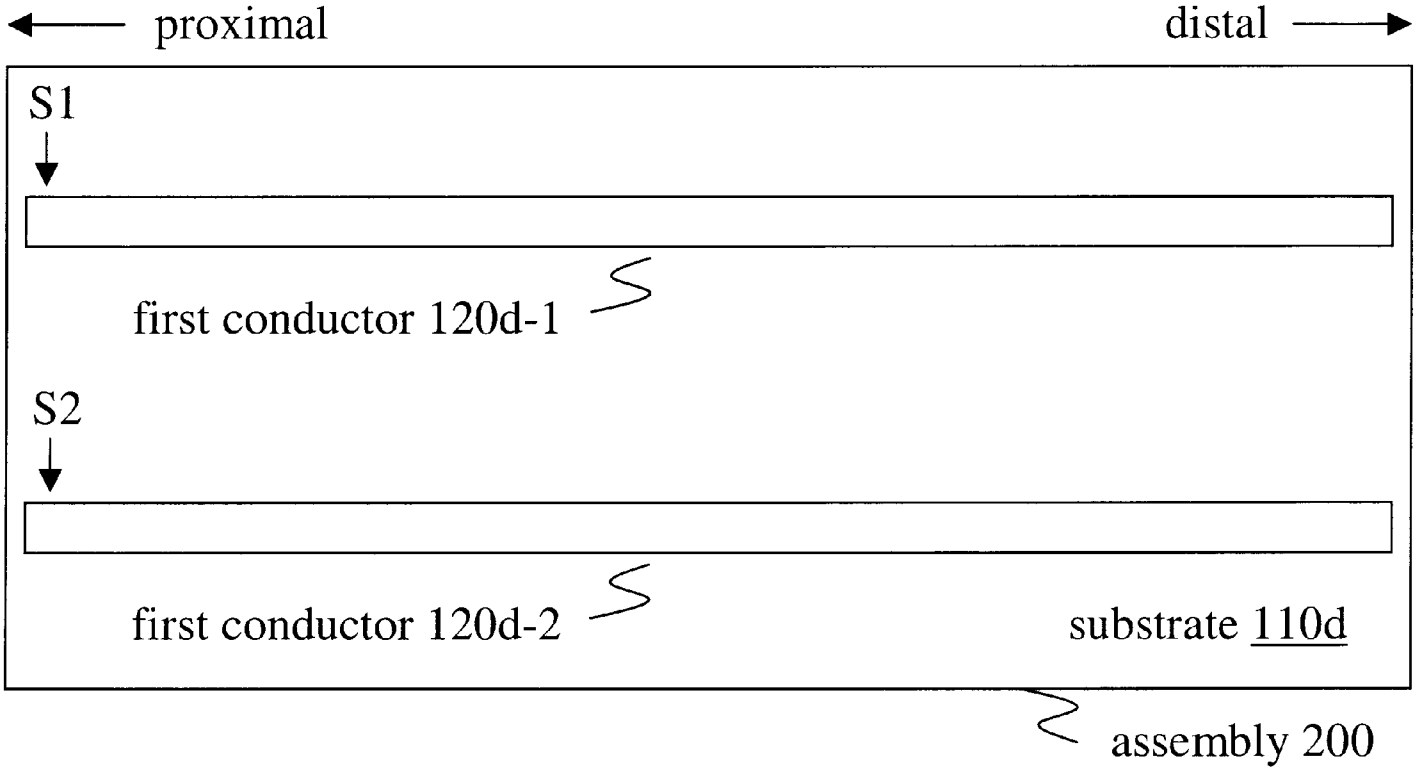
FIG. 11 shows a top view of an assembly according to an embodiment of the invention.
Figure 12:
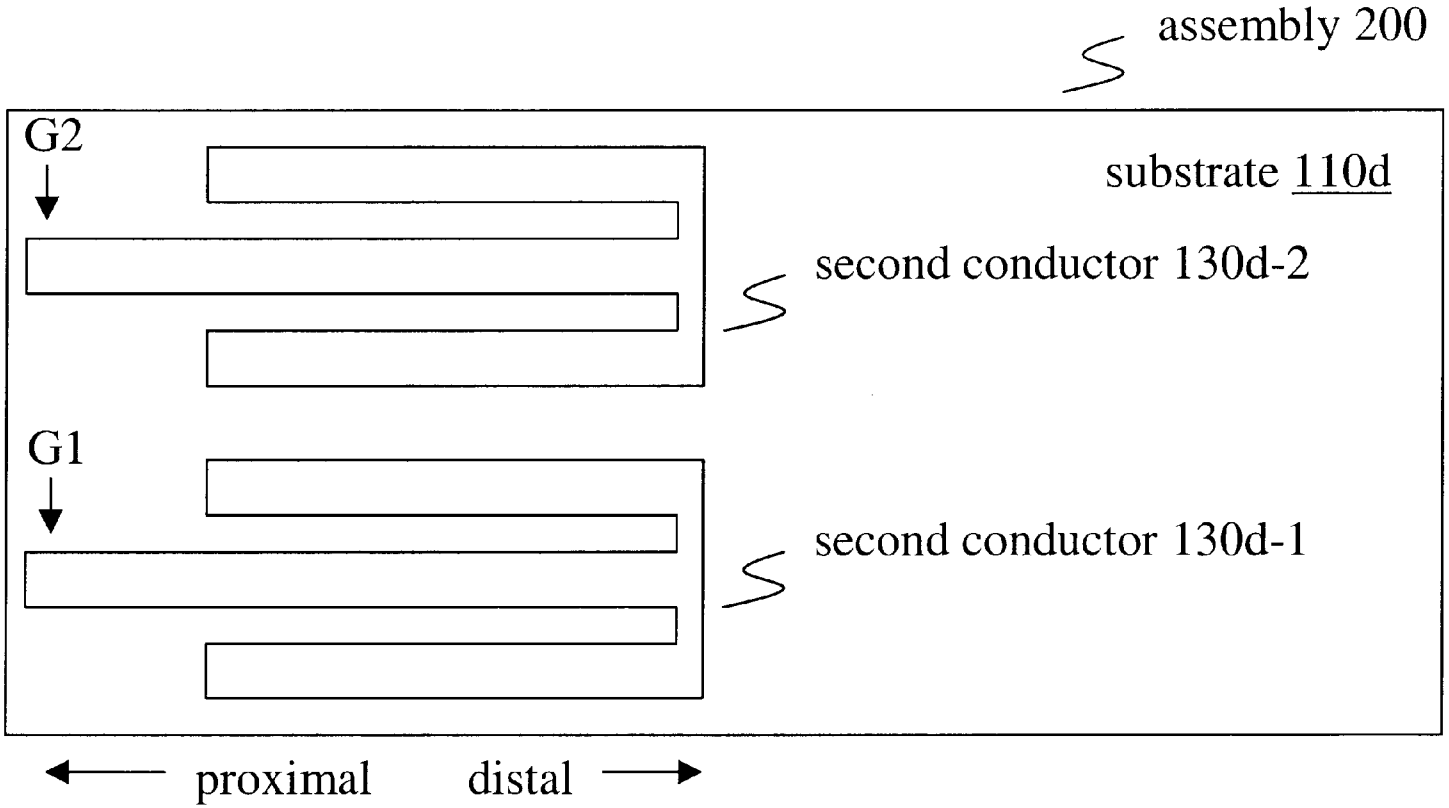
FIG. 12 shows a bottom view of an assembly according to an embodiment of the invention as shown in FIG. 11.

It may be desirable to fabricate an assembly having more than one antenna as described herein. FIG. 11 shows a top side of an antenna assembly 200 according to an embodiment of the invention having two first conductors 120*d*-1, 120*d*-2 on a top surface of a substrate 110*d* (with two corresponding source connection points designated as S1 and S2), and FIG. 12 shows a bottom side of antenna assembly 200 having corresponding second conductors 130*d*-1, 130*d*-2 (with corresponding ground connection points G1 and G2). Such an assembly may contain an arbitrary number of antennas having one or more single- and/or double-sided designs as described herein, the various antennas being designed to operate over the same frequency or frequency range (e.g. for spatial diversity applications) and/or different frequencies or frequency ranges (e.g. for frequency diversity applications and/or for dual-band operation).

An antenna as described herein may have a radiation pattern that is directional. For example, the radiation pattern of such an antenna may tend to have a null along the axis of the antenna. Therefore, it may be desirable to configure a particular application of such an antenna according to an appropriate orientation with respect to a receiver to which the antenna is expected to radiate (or, a transmitter from which the antenna is expected to receive a signal).

In an application to a portable wireless device, for example, an antenna may be expected to radiate to a tower located in a generally horizontal direction with respect to the device. In this case, it may b e desirable to configure the application such that the antenna will likely be aligned in a direction other than horizontal or parallel to the earth (for example, in a direction perpendicular to the earth) during use.

Figure 13B:
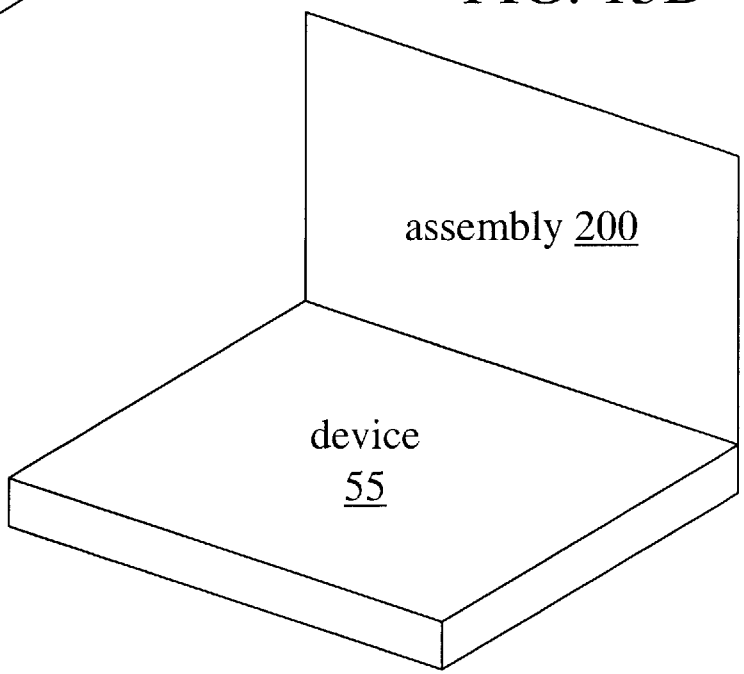
FIGS. 13A, 13B show perspective views of a portable device having an assembly according to an embodiment of the invention in various stages of deployment.
Figure 13A:
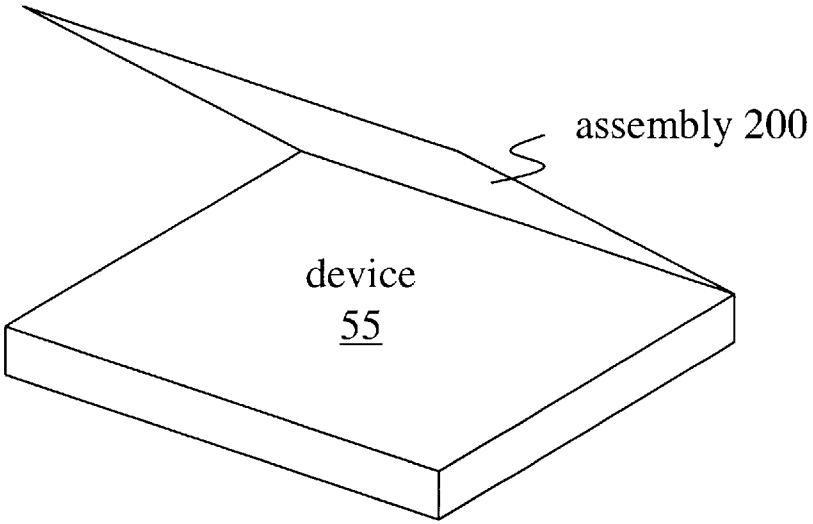

In one application, an antenna assembly as described above may be stored flat against a portable device when not in use (e.g. as a cover plate to the device). FIG. 13A demonstrates how antenna assembly 200 may be hinged to a portable device 55 to be pivoted into a partly extended position, and FIG. 13B shows antenna assembly 200 in a fully extended position relative to portable device 55. Assuming that assembly 200 is generally intended to be perpendicular to the earth during use, it may be desirable to orient the individual antennas in such an assembly 200 such that when the assembly is extended, their longitudinal axes intersect the edge of device 55 that meets assembly 200.

Figure 13D:
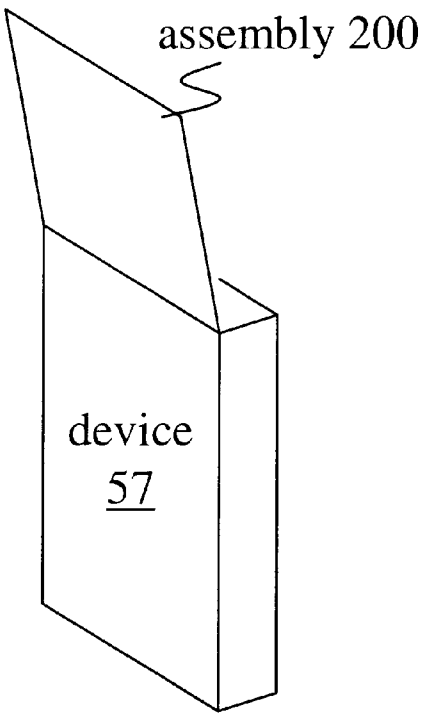
FIGS. 13C, 13D show perspective views of a portable device having an assembly according to an embodiment of the invention in various stages of deployment.
Figure 13C:
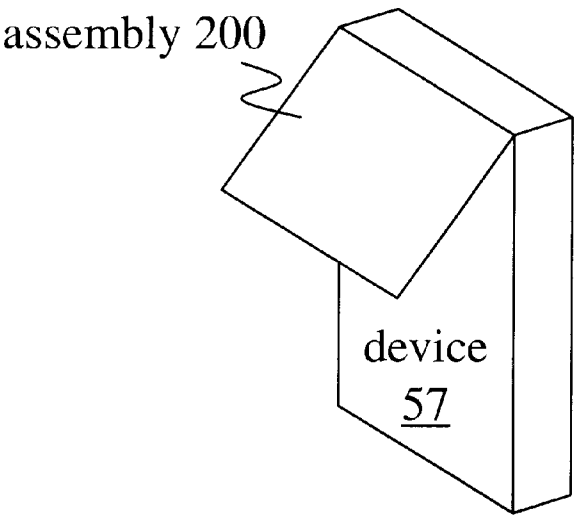

A portable device 55 as shown in FIGS. 13A,B may be generally intended for use while oriented parallel to the earth (such as on a tabletop). FIGS. 13C and 13D show how antenna assembly 200 may be hinged to a portable device 57 to be pivoted into partly and fully extended positions, respectively, in a case where portable device 57 is generally intended for use while oriented perpendicular to the earth (or nearly so).

One advantage that may be realized in an antenna according to an embodiment of the invention is that the feed point is moved away from the connection of the antenna to the driving device. As compared to a monopole whip design, use of such an antenna may reduce or avoid blockage of the radiated signal (e.g. by the user's head and/or hand) in an application such as a cellular telephone or other handheld device.

For example, an antenna according to an embodiment of the invention may be installed such that the radiating element (e.g. the poise and counterpoise portions) are away from a user's hand and head during operation, unlike a typical unbalanced antenna design which may excite the PCB to which it is connected as the lower half of a dipole antenna. Possible benefits include a reduction in measured specific absorption rate (SAR) and/or an increase in achievable effective isotropic radiated power (or EIRP) outputted by the device, which may in turn improve a performance of the device within a wireless network and increase a battery life of the device.

In a case where the portable device (e.g. a wireless modem) is designed for operation when inserted into a PCMCIA slot of a laptop computer, use of a monopole whip or other unbalanced design may lead to RF coupling and consequent radiation within the laptop body. Use of one or more antennas or antenna assemblies according to embodiment of the invention may help to confine radiation emission to elements that are outside of the laptop body, thereby reducing pattern distortions, efficiency losses, and problems of interference with other electronics of the host device (in this example, the laptop computer).

Figure 14:
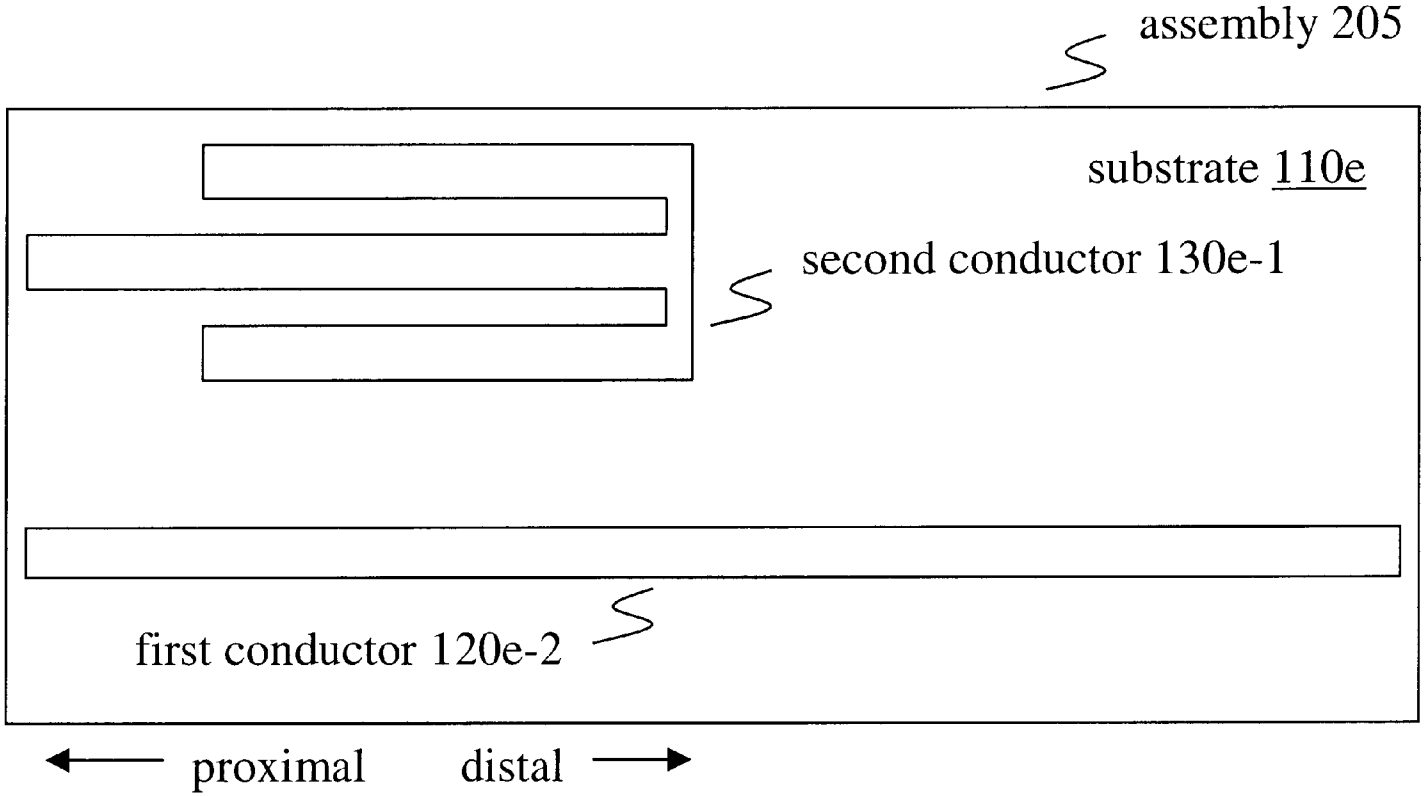
FIG. 14 shows a top view of an assembly according to an embodiment of the invention.
Figure 15:
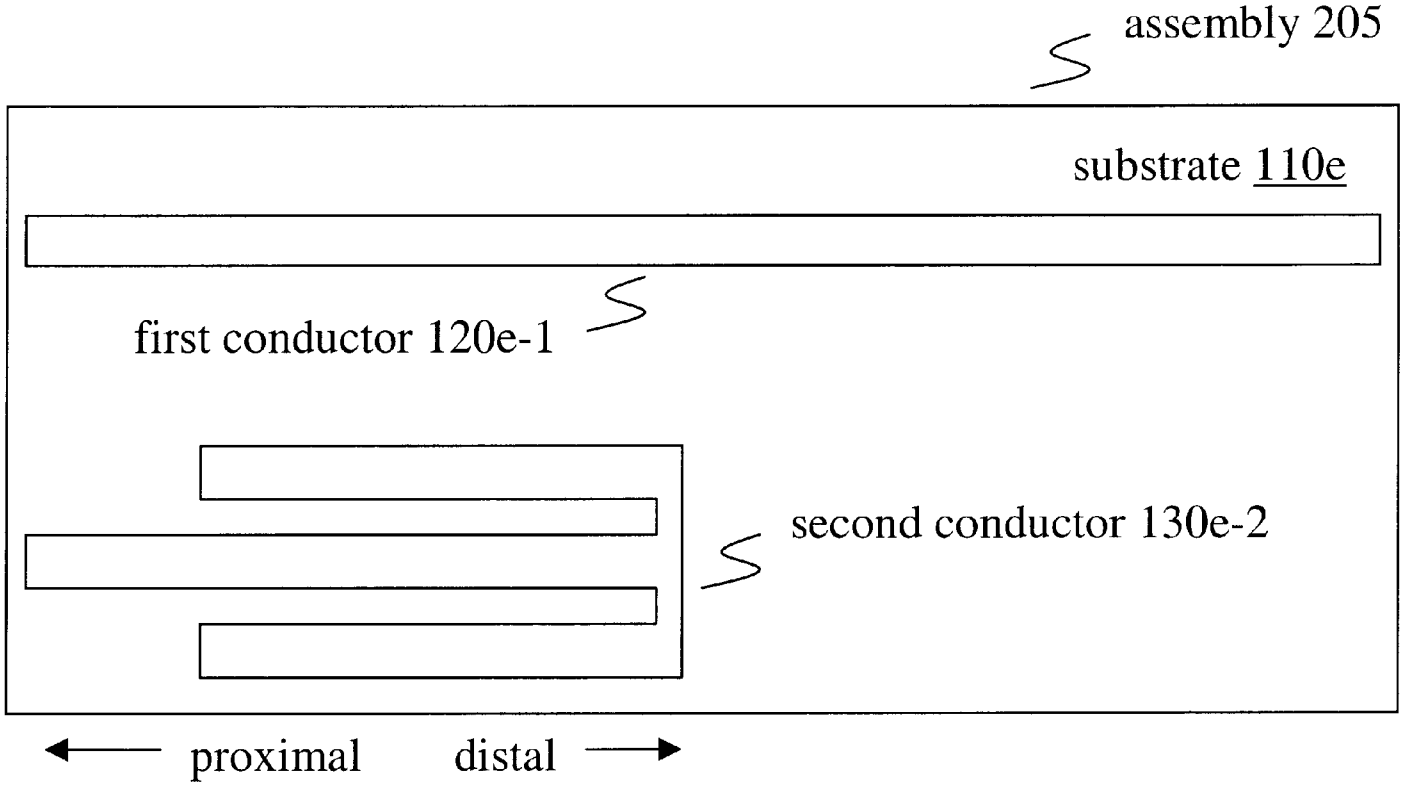
FIG. 15 shows a bottom view of an assembly according to an embodiment of the invention as shown in FIG. 14.

An assembly having more than one antenna according to an embodiment of the invention may also be fabricated such that one or more first conductors are on the same side of substrate 110*d* as one or more second conductors, with the corresponding second and first conductors being on the other side of substrate 110*d*. An example of such an assembly 205 that includes two antennas is shown in FIGS. 14 (top side) and 15 (bottom side). As noted above, such an assembly may include an arbitrary number of antennas, possibly including one or more antennas of single-sided design.

Figure 16:
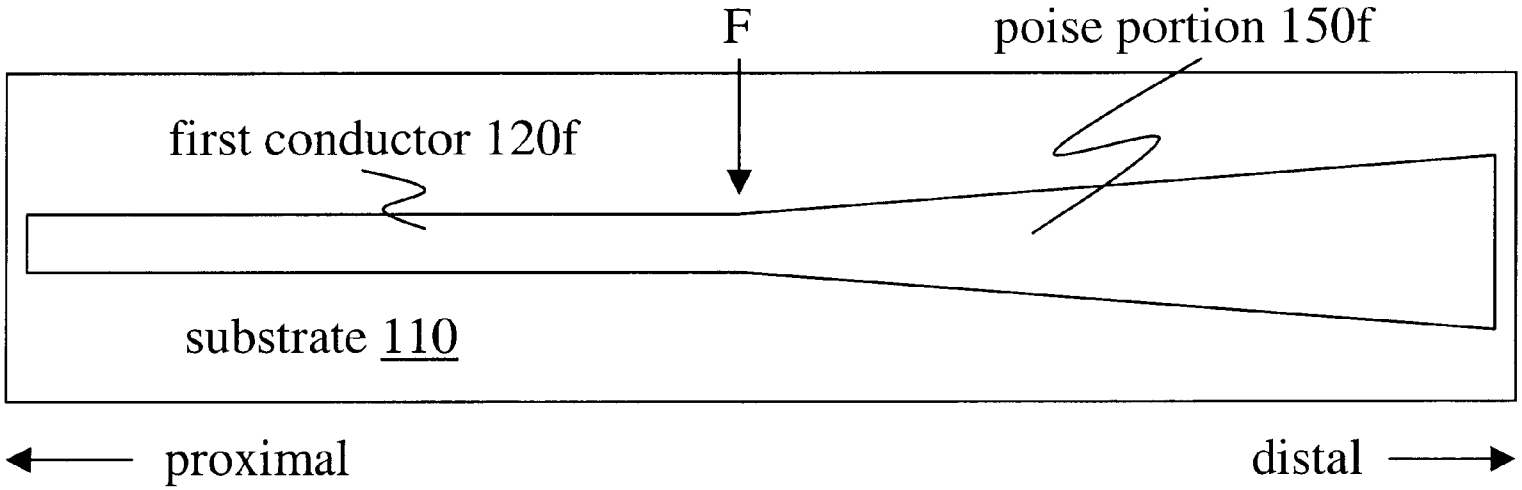
FIG. 16 shows a top view of an antenna according to an embodiment of the invention having a flared poise portion.

It may be desirable to use different shapes for the feed line and poise portions 140, 150 of first conductor 120. For example, increasing a diameter of poise portion 150 may have the effect of increasing the operating bandwidth of the antenna. FIG. 16 shows a top view of an antenna according to an embodiment of the invention where a diameter of first conductor 120*f* increases as one passes along first conductor 120*f* from feed point F to the proximal end (i.e. poise portion 150*f* is flared). Other possible designs include increasing a diameter of poise portion 150 to a maximum diameter close to feed point F and continuing that maximum diameter along the remainder of poise portion 150 (i.e. to the distal end of first conductor 120).

Figure 17A:
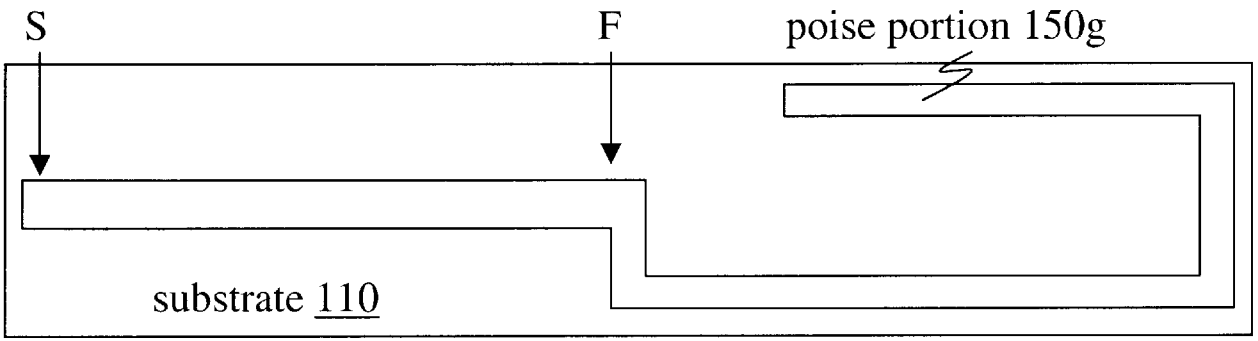
FIGS. 17A, 17B show top views of antennas according to embodiments of the invention including first conductors having bent and meandered poise portions, respectively.
Figure 17B:
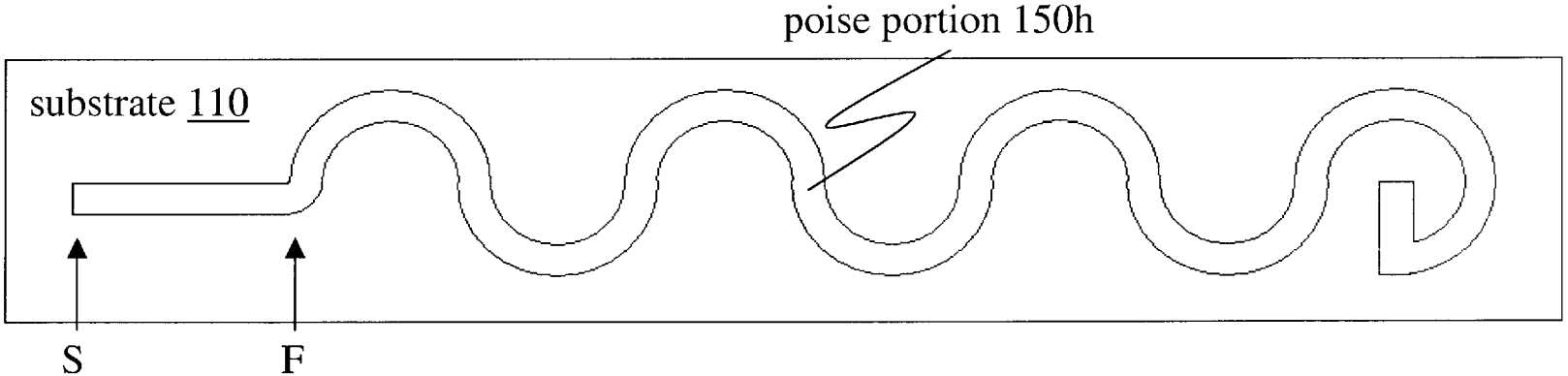

FIG. 17A shows a top view of an antenna according to another embodiment of the invention having a folded poise portion 150*g*. FIG. 17B shows a top view of an antenna according to another embodiment of the invention having a meandered poise portion 150*h*. Compacted poise portions such as these may have the advantage of reducing a physical size of the antenna for a given resonant frequency by providing a longer effective length of the radiating portion. Such a reduction of the ratio of physical length to effective length may be especially useful at a lower range (e.g. 800–900 MHz) of the frequencies commonly utilized for personal wireless communications.

In a single-sided design as shown in FIG. 1, considerations for manufacturability (e.g. accuracy, alignmrent, reproducibility) of the widths of the strips of the second conductor, and of the widths of the gaps between those strips and the first conductor, may limit the range of line impedances that are achievable with such a design in practice. A microstrip-fed design as shown in FIGS. 2A, 2B, and 3 may allow for more tolerance to manufacturing deviations as well as more flexibility in changing an impedance from one part of the antenna to another.

For example, it may be desirable in a particular application to improve a match between the antenna impedance at point F and the RF source impedance at point S. In an antenna according to a further embodiment of the invention, an impedance of feed line portion 140 (e.g. at the desired frequency or frequency range of operation) is adjusted. Such adjustment may be accomplished, for example, by varying the width of feed line portion 140 or a portion thereof (e.g. a portion adjacent to feed point F).

In one implementation, the width of a transformer portion of feed line portion 140 is selected such that the impedance of the transformer portion is the geometric mean of the antenna driving point impedance (nominally about 70 ohms but possibly another value) and the RF source impedance (normally 50 ohms). In a particular and non-limiting example, the nominal antenna driving point impedance is 70 ohms and the RF source impedance is 50 ohms.

Figure 18:
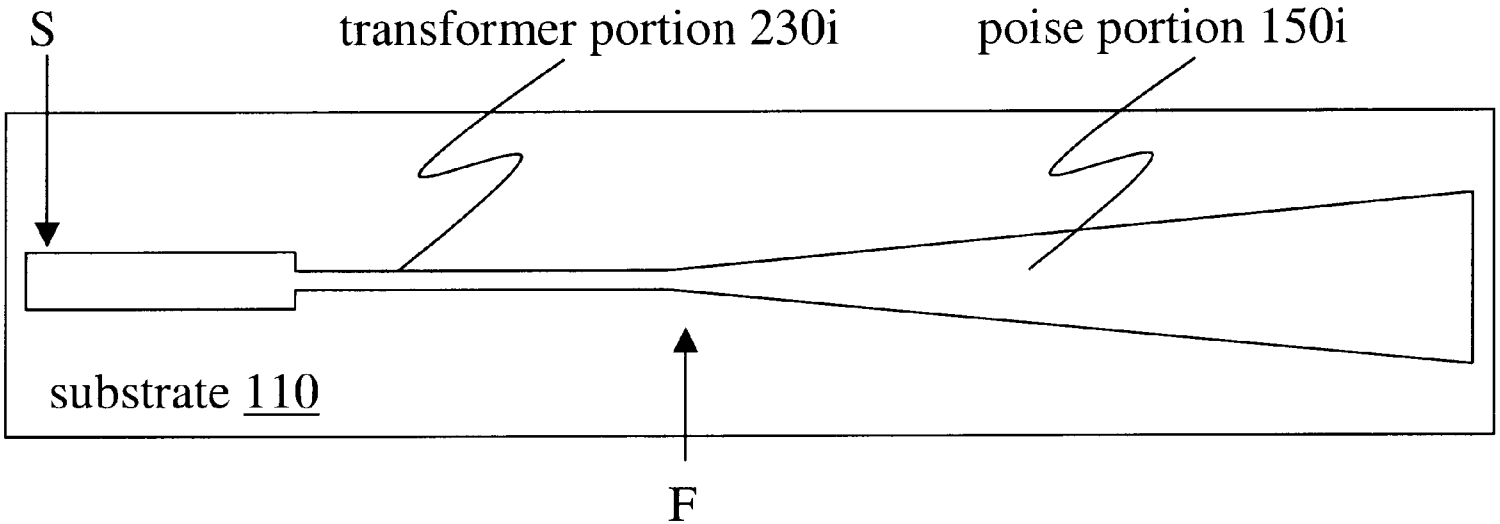
FIG. 18 shows a top view of an antenna according to an embodiment of the invention including a first conductor having a transformer portion.

FIG. 18 shows a top view of an antenna according to such an embodiment of the invention that also includes a flared poise portion 150*i*. For the impedance matching effect to be realized, it may be desirable for transformer portion 230*i*

(which extends to feed point F) to have a length equal to one quarter-wavelength at a center frequency of the desired band of operation. Depending on the desired frequency or frequency range of operation, it may be desirable to smooth the transition points at one or both ends of the transformer section. For example, such smoothing may not be necessary for use in the AMPS (Advanced Mobile Phone Services) range of 800–900 MHz, or in the PCS (Personal Communications Services) range of 1850–1990 MHz, but may be desirable at higher frequencies.

As noted above, it may be desirable for the effective lengths of stubs 180,190 and transformer portion 230 to be one quarter-wavelength. However, stubs 180,190 may operate in a coplanar waveguide environment, while transformer portion 230 may operate in a microstrip waveguide (or transmission line) environment. As the relation between effective and physical length may depend upon the relevant waveguide environment, the physical length of transformer portion 230 may differ from that of stubs 180,190 even in an application where both structures are configured to have effective lengths of one quarter-wavelength.

Figure 19A:
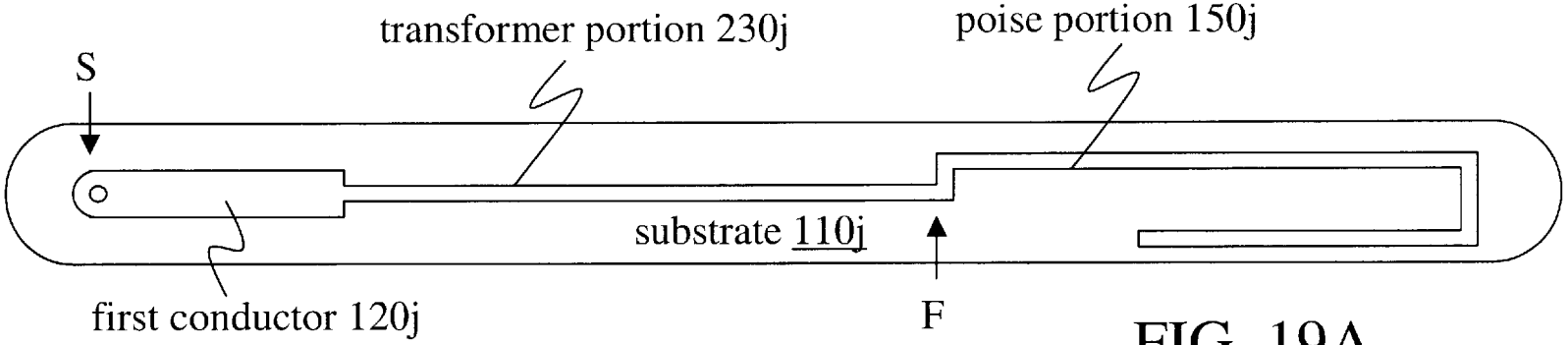
FIGS. 19A, 19B show top and bottom views of an antenna according to an embodiment of the invention including a first conductor having a transformer portion and a bent poise portion.
Figure 19B:
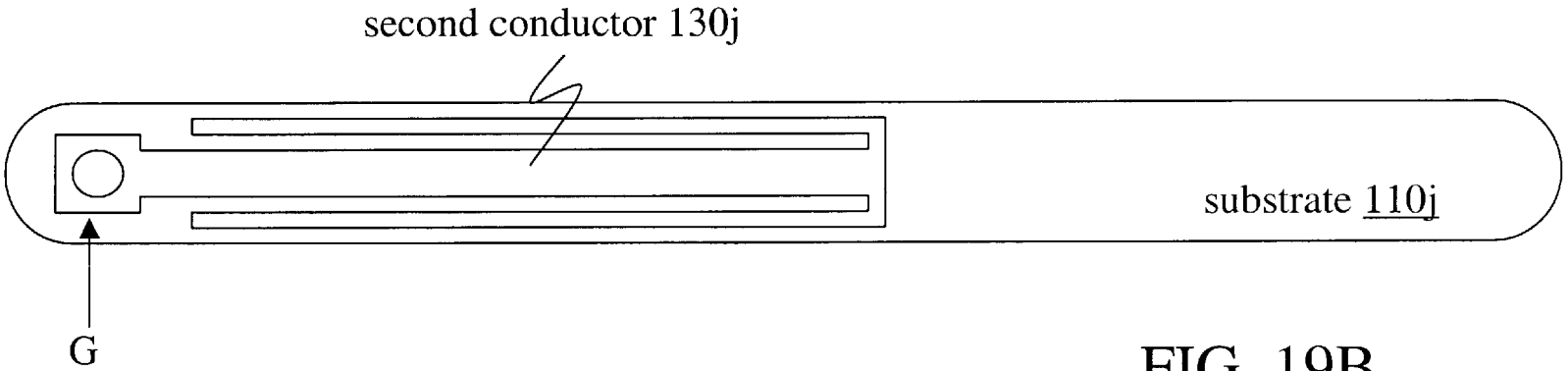

FIG. 19A shows a top view of an antenna according to an embodiment of the invention that includes a transformer section 230*j* and a folded poise section 150*j* of a surface of substrate 110*j*. FIG. 19B shows a bottom view of an antenna as shown in FIG. 19A, including second conductor 130*j*. In this example, first conductor 120*j* and second conductor 130*j* are configured (at source and ground connection points S and G, respectively) for attachment of coaxial cable leads.

Figure 20A:
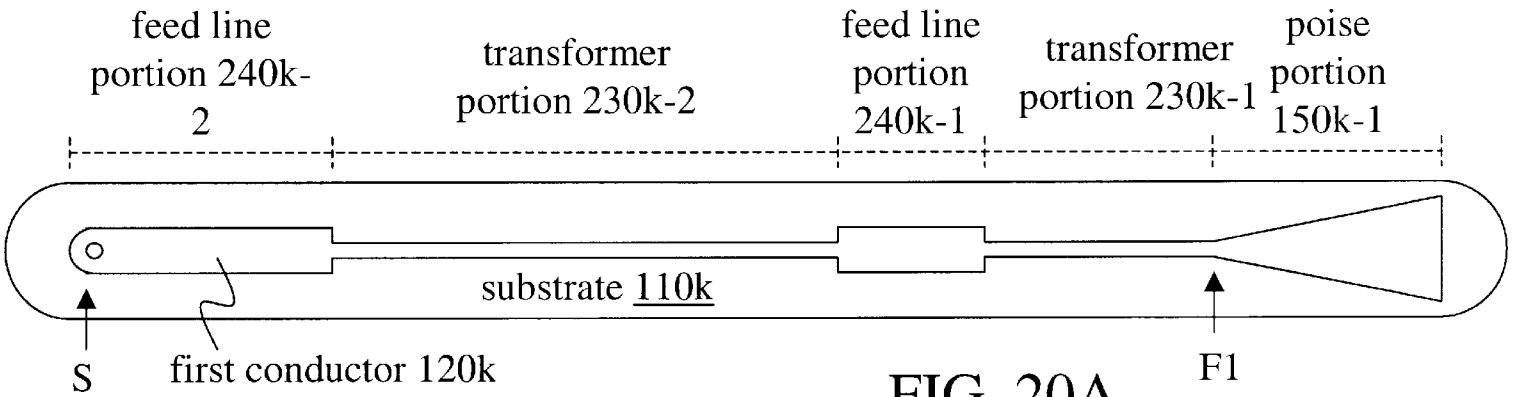
FIGS. 20A,B show top and bottom views of an antenna according to an embodiment of the invention including two antenna structures being stacked in a collinear fashion.
Figure 20B:
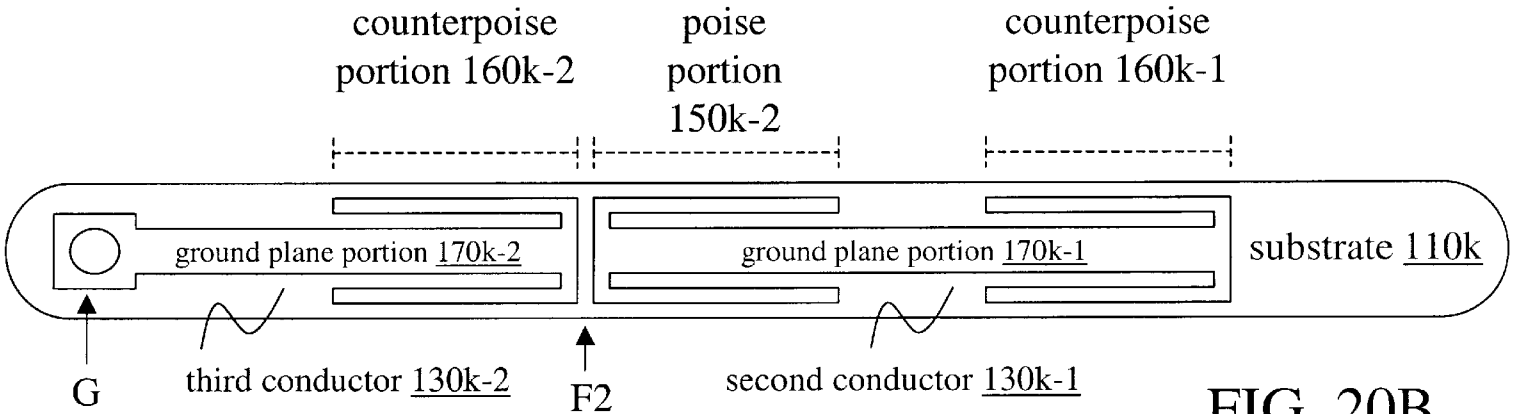

In an array according to another embodiment of the invention, two or more antenna structures may be stacked in a collinear fashion. FIGS. 20A and 20B show top and bottom views of an antenna according to one such embodiment of the invention. Possible advantages of such a configuration include a higher gain while maintaining an omni-directional radiation pattern in a plane perpendicular to the antenna axis.

As shown in FIG. 20A, first conductor 120*k* includes poise portion 150*k*-1, transformer portion 230*k*-1, and feed line portion 240*k*-1 of a first (active) antenna structure, and transformer portion 230*k*-2 and feed line portion 240*k*-2 of a second (linking) antenna structure. As shown in FIG. 20B, second conductor 130*k*-1 and third conductor 130*k*-2 are arranged on the other side of substrate 110*k*. Second conductor 130*k*-1 includes counterpoise portion 160*k*-1 and ground plane portion 170*k*-1 of the first antenna structure and poise portion 150*k*-2 of the second antenna structure, and third conductor 130*k*-2 includes counterpoise portion 160*k*-2 and ground plane portion 170*k*-2 of the second antenna structure.

The first antenna structure, which actively radiates a driving signal (and/or receives a transmitted signal), may have a configuration generally similar to an antenna according to one of the embodiments disclosed above, with poise and feed line portions on one side of the substrate and counterpoise and ground plane portions on the other. The second antenna structure, which links the first antenna structure to an excitation source (and/or to a receiver) also has a feed line portion on one side of the substrate and ground plane and counterpoise portions on opposite sides of the substrate. However, unlike the first antenna portion, the poise portion of the second antenna structure is on the same side as the counterpoise portion. An antenna array according to another embodiment of the invention may include more than one linking structure in series with an active structure.

As noted above, it may be desirable for one or more of the poise and counterpoise portions to have an effective length of one quarter-wavelength (e.g. at the center frequency of a desired operating band). In an embodiment that includes one or more transformer portions (e.g. as shown in FIG. 20A), it may also be desirable for one or more of the transformer portions to have an effective length of one quarter-wavelength.

In order to obtain in-phase excitation of the antenna structures, it may be desirable to configure the feed line portion between the structures (here, portion 240*k*-1) according to a desired phase adjustment. For example, it may be desirable for the feed points of the two structures (designated as F1 in FIG. 20A and F2 in FIG. 20B) to be separated by an effective distance of about 0.7 wavelengths. In one such configuration, the effective lengths of counterpoise portion 160*k*-1 and poise portion 150*k*-2 (which may have the same shape or different shapes) are one quarter-wavelength, and the effective length of feed line portion 240*k*-1 is 0.2 wavelength.

In a practical application, it may be desirable to encase an antenna according to an embodiment of the invention in a plastic cover or radome. In such case, the dimensions of the antenna may be scaled slightly to account for any detuning of the antenna by the radome.

The foregoing presentation of the described embodiments is provided to enable any person skilled in the art to make or use antennas according to such embodiments of the present invention. Various modifications to these embodiments are possible, and the generic principles defined herein may be applied to other embodiments as well. Thus, the present invention is not intended to be limited to the embodiments or materials described herein but is to be accorded the widest scope consistent with the claims set forth below.

What is claimed is:

1. An antenna comprising:

a substrate having two opposing surfaces;

a first conductor disposed on one surface of the substrate, said first conductor having a feed line portion and a poise portion;

a second conductor disposed on the opposite surface of the substrate, said second conductor having a ground plane portion and a counterpoise portion; and a third conductor disposed on the surface of the substrate on which the second conductor is disposed;

wherein the first conductor has a second feed line portion, the second conductor has a poise portion, and the third conductor has a counterpoise portion and a ground plane portion.

2. The antenna according to claim 1, wherein the feed line portion is further disposed adjacent to the ground plane portion and is configured and arranged to operate as a microstrip transmission line.

3. The antenna according to claim 1, wherein at least a portion of the second conductor including the counterpoise portion is configured and arranged to operate as a coplanar waveguide.

4. The antenna according to claim 3, wherein the antenna is configured and arranged to be excited by an RF signal within a predetermined frequency range, and wherein the poise portion has an effective length substantially equal to $\lambda/4$, $\lambda$ denoting a wavelength corresponding to a frequency within the predetermined frequency range, and wherein the coplanar waveguide is configured and arranged to impede a flow of a current over the predetermined frequency range.

5. The antenna according to claim 3, wherein the antenna is configured and arranged to be excited by an RF signal within a predetermined frequency range, and wherein the poise portion has an effective length substantially equal to $\lambda/4$, $\lambda$ denoting a wavelength corresponding to a frequency within the predetermined frequency range, and wherein the coplanar waveguide is configured and arranged to have an input impedance that is substantially infinite over the predetermined frequency range.

6. The antenna according to claim 3, wherein the coplanar waveguide is configured and arranged to function as a radio-frequency choke.

7. The antenna according to claim 3, wherein the counterpoise portion comprises a first stub disposed on one side of the ground plane portion and a second stub disposed on an opposing side of the ground plane portion.

8. The antenna according to claim 7, wherein each of the first and second stubs is disposed substantially parallel to the ground plane portion.

9. The antenna according to claim 7, wherein the antenna is configured and arrange d to be excited by an RF signal within a p redetermined frequency range, and wherein the poise portion ha s an effective length substantially equal to $\lambda/4$, $\lambda$ denoting a wavelength corresponding to a frequency within the predetermined frequency range, and wherein an effective length of each of said two stubs is substantially equal to $\lambda/4$.

10. The antenna according to claim 1, the first conductor further comprising a transformer portion disposed between the feed line portion and the poise portion, the transformer portion being configured and arranged to match an impedance of the feed line portion at a frequency within the predetermined frequency range to an impedance of the poise portion at a frequency within the predetermined frequency range.

11. The antenna according to claim 10, wherein a width of the transformer is less than a width of the feed line.

12. The antenna according to claim 10, wherein the first conductor is configured and arranged to receive a signal from an RF source, and wherein at least one among the poise portion and the counterpoise portion has an effective length substantially equal to one quarter-wavelength at a frequency of the signal, and wherein an effective length of the transformer is substantially equal to one quarter-wavelength at a frequency of the signal.

13. The antenna according to claim 1, wherein a dimension of the ground plane portion in a longitudinal direction is substantially greater than a dimension of the ground plane portion in a transverse direction.

14. The antenna according to claim 1, wherein the second feed line portion is further disposed adjacent to the ground plane portion of the third conductor and is configured and arranged to operate as a microstrip transmission line.

15. The antenna according to claim 1, wherein at least a portion of the third conductor including the counterpoise portion is configured and arranged to operate as a coplanar waveguide.

16. The antenna according to claim 15, wherein the antenna is configured and arranged to be excited by an RF signal within a predetermined frequency range, and wherein the poise portion of the second conductor has an effective length substantially equal to $\lambda/4$, $\lambda$ denoting a wavelength corresponding to a frequency within the predetermined frequency range, and wherein the coplanar waveguide is configured and arranged to impede a flow of a current over the predetermined frequency range.

17. The antenna according to claim 16, wherein the counterpoise portion of the third conductor comprises a first stub disposed on one side of the ground plane portion and a second stub disposed on an opposing side of the ground plane portion, and wherein the poise portion of the second conductor has an effective length substantially equal to $\lambda/4$, $\lambda$ denoting a wavelength corresponding to a frequency within the predetermined frequency range, and wherein an effective length of each of said two stubs is substantially equal to $\lambda/4$.

18. The antenna according to claim 1, the first conductor further comprising a transformer portion disposed between the feed line portion and the poise portion, the transformer portion being configured and arranged to match an impedance of the feed line portion to an impedance of the poise portion.

* * * * *

UNITED STATES PATENT AND TRADEMARK OFFICE

CERTIFICATE OF CORRECTION

PATENT NO. : 6,559,809 B1 
DATED : May 6, 2003
INVENTOR(S) : Alireza H. Mohammadian, Ernest T. Ozaki and Patrick J. Connor It is certified that error appears in the above-identified patent and that said Letters Patent is hereby corrected as shown below:

Title page,
Item [75], Inventors, please replace "Conner" with -- Connor --.

Signed and Sealed this

Twenty-ninth Day of July, 2003

JAMES E. ROGAN
*Director of the United States Patent and Trademark Office*